US006162061A

United States Patent [19]

Taylor

[11] Patent Number: 6,162,061

[45] Date of Patent: Dec. 19, 2000

[54] MULTIPLE TRAMPOLINE SIMULATION APPARATUS AND METHOD

[76] Inventor: Rogan L. Taylor, 1087 E. Bretonwoods La., Orem, Utah 84097

[21] Appl. No.: 09/208,677

[22] Filed: Dec. 10, 1998

[51] Int. Cl.[7] ..... A63B 69/18

[52] U.S. Cl. ..... 434/253; 482/27

[58] Field of Search ..... 482/23, 27, 28, 482/29; 434/247, 253

[56] References Cited

U.S. PATENT DOCUMENTS

| | | | |
|---|---|---|---|
| 4,483,531 | 11/1984 | Laseman et al. | 482/27 |
| 4,730,826 | 3/1988 | Sudmeier | 482/27 |
| 4,824,100 | 4/1989 | Hall et al. | 482/27 |
| 5,007,638 | 4/1991 | Yuki | 482/27 |

*Primary Examiner*—Sam Rimell
*Attorney, Agent, or Firm*—Trask Britt

[57] ABSTRACT

A ski simulator apparatus is provided in which two rebounders or miniatures trampolines are maintained and secured in a common framework. The rotatable frame members supporting each trampoline are adjustable to vary the incline of one trampoline relative to the other so as to simulate different size and shapes of moguls. The framework includes receptacles for accepting and securing the legs of conventional rebounders or trampolines therein. The entire unit may be disassembled by removing trampolines and folding the framework upon itself to facilitate storage and transportation.

19 Claims, 6 Drawing Sheets

MULTIPLE TRAMPOLINE SIMULATION APPARATUS AND METHOD

BACKGROUND

1. Field Of The Invention

The present invention is related to a multiple-trampoline practice apparatus. More particularly, the present invention concerns an apparatus having at least two small trampolines in a common framework which are adjustable with respect to each other to provide an apparatus for simulating skiing and snowboarding. As used herein, the term "skiing" shall always include both skiing and snowboarding.

2. Technical Background

Small round trampolines, sometimes referred to as rebounders, have become popular as an exercise device, particularly at home. Using rebounders to exercise provides the advantages of easy availability, privacy and reliability regardless of the weather.

Rebounders are commonly used for indoor bouncing and jogging, as shown in U.S. Pat. No. 4,336,933 (Applebaum). However, rebounders have also proven to be useful in practicing various sports activities, such as boxing (U.S. Pat. No. 5,607,377, Wilkinson), baseball (U.S. Pat. No. 5,007, 638, Yukl), soccer (U.S. Pat. No. 4,478,420, Sowards) and as a multipurpose athletic training device U.S. Pat. No. 5,613, 922, Hsiang). In such uses, usually an auxiliary device is attached to the rebounder and/or the rebounder is pitched or inclined to accommodate the sport being practiced.

Multiple trampolines or rebounders in a common apparatus have not been commonly used. One such use, shown in U.S. Pat. No. 5,336,135 (Keyvani), is described as an amusement apparatus in which a series of trampolines are arranged vertically in stair-step fashion to enable a user, starting at the top to spring serially from the uppermost to the lower trampolines into a pool of water or bed of foam at the bottom. A tram is provided to deliver the user back to the top of the apparatus.

In the sports of skiing and snowboarding, one of the most difficult skills to learn is skiing or jumping moguls. The skill requires a jumping motion timed with the swiveling of hips and lower torso to navigate the moguls. Learning is particularly complicated because the moguls differ in size, spacing and angle of incline. A means of initially learning the mogul jumping motion is needed in a simulated setting in which some of the above variables are eliminated while retaining the basic mogul structure and conditions.

U.S. Pat. No. 4,483,531 (Laseman et al.) shows a pair of trampolines which are spaced apart but sufficiently close together so that a person can rebound from one device to the other using first one leg on one trampoline and then the other leg on the other trampoline without contacting or touching the floor. The trampolines are angled towards each other so as to facilitate a bouncing from leg to leg. The Laseman patent does not provide any means for adjusting the slant of the trampolines relative to each other to simulate varied and/or difficult terrain and moguls nor does it contemplate bouncing with both legs from one trampoline to the other.

U.S. Pat. Nos. 4,730,826 (Sudmeier) and 4,824,100 (Hall et al) both show rectangular trampolines surfaces having a center bar to separate the two sides of the trampoline and providing for means to angle the two sides relative to each other to provide opposing rebound surfaces. In the Sudmeier patent, the concept is disclosed of using the opposing rebounding surfaces to simulate downhill skiing by bouncing back and forth between the opposing surfaces while holding onto ski poles which are inserted in holes at the front of the trampoline to help the user retain balance. The Sudmeier device does not provide for an adjustment of the angle between the rebounding surfaces. In Hall, adjustable legs are provided to provide some minor adjustment of the two surfaces. Both the Hall and Sudmeier apparatus require fairly complicated mechanisms running down the center of the trampolines to hold the mat in tension as it is partially folded to provide opposing surfaces.

Neither the Sudmeier nor the Hall apparatus provide any means for separating the impact on one side of the apparatus for the impact in the other side. By using a common mat surface, both the Sudmeier and Hall devices are susceptible to unwanted vibration or movement affecting the other side of the surface. This action does not provide separate and distinctive surfaces to clearly simulate skiing conditions.

What is needed is a ski simulation apparatus which presents at least two separate and independent inclined surfaces for simulating jumping from one mogul to another. Moreover, a ski simulation apparatus is needed in which of two surfaces can be separately inclined at a variety of different pitches to simulate various skiing conditions. In addition, a ski simulation is needed which is rugged and strong to absorb the impact of a person simulating skiing conditions and to remain stable and stationary on a surface during skiing exercises. Finally, a ski simulation apparatus is needed which disassembles into a relatively lightweight and compact unit for movement.

BRIEF SUMMARY OF THE INVENTION

The present invention is directed to a novel rebounder apparatus in which at least two rebounders are secured in a common framework adjacent to each other to provide for athletic training. In one preferred embodiment, the rebounders are arranged to provide training in downhill skiing and snowboarding, particularly navigating through moguls. The rebounders are disposed side by side in a common structure and are each independently adjustable in angle relative to each other to simulate different sizes and shapes of moguls.

In one preferred embodiment, a framework includes a first frame having a plurality or receptacles, each disposed for receiving a leg of a conventional rebounder or miniature trampoline therein to secure the rebounder firmly in position on the framework. Each of the two frames are spaced from each other a short distance and are adjustable at one end to vary the incline or pitch of each rebounder relative to the other. The common framework includes a free standing handle attached to the framework for a user to grasp during the exercises. In a preferred embodiment, a hinge is also provided in the framework for enabling the framework to be folded at the center to facilitate being transported.

The present invention is also directed to a novel method of providing athletic training using at least two rebounders located adjacent to each other in a common structure. The method includes jumping or springing from one rebounder to the other at different speeds and intensity to simulate skiing moguls. The method may also include changing the angle of one rebounder relative to the other, resulting in multiple variations in the simulated mogul skiing conditions from flat to a steep angle.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention is rendered by reference to the appended drawings. These drawings only provide information concerning typical embodiments of the invention and are not considered to limit the scope of the invention. Reference is made to the drawings in which.

DETAIL DESCRIPTION OF THE PREFERRED EMBODIMENTS

Figure 1:
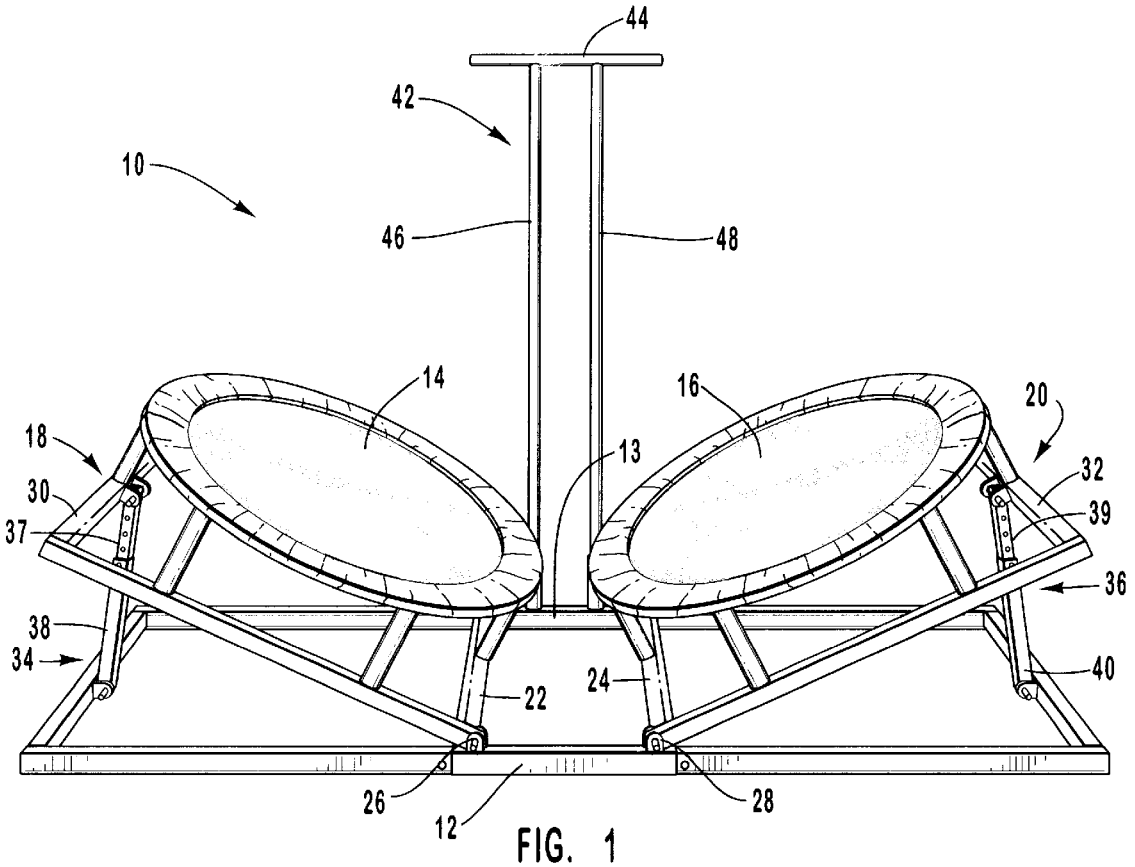
FIG. 1 is a perspective view of a preferred embodiment of the ski simulation apparatus of the present invention.

Referring first to FIG. 1, a preferred embodiment is shown of the ski simulating apparatus 10 of the present invention. Apparatus 10 includes a base framework 12 being large enough to encompass the diameters of two miniature rebounders 14 and 16 therein. Opposing frames 18 and 20 are pivotally connected to base 12 at adjacent ends 22 and 24 by corresponding hinge pieces 26 and 28. The opposite ends 30 and 32 of frames 18 and 20 are each connected to base 12 by a centrally disposed leg 34 and 36, respectfully. Each of legs 34 and 36 comprise two tubular pieces 37 and 38, 39 and 40, respectfully, which telescope within each other to allow the first and second frames 18 and 20 to be inclined at various pitches towards each other and with respect to. As frames 18 and 20 are inclined, the surfaces of rebounders 14 and 16 are also inclined towards each other are different pitches. It can be seen that each frame 18 and 20 and therefore each trampoline 14 and 16 can be independently inclined or pitched relative to the other so that one trampoline can be near horizontal while the other one is substantially inclined towards the vertical. Alternately, each trampoline can be inclined at the same pitch towards the center so that they simulate equally pitched moguls.

An upright handle 42 consists of a cross bar 44 mounted between two vertical posts 46 and 48 which extend vertically downward to the rear side 13 of base 12 where they are secured there to. Alternately, additional handles may be added to the cross bar 44 at different heights to accommodate various users.

Figure 2:
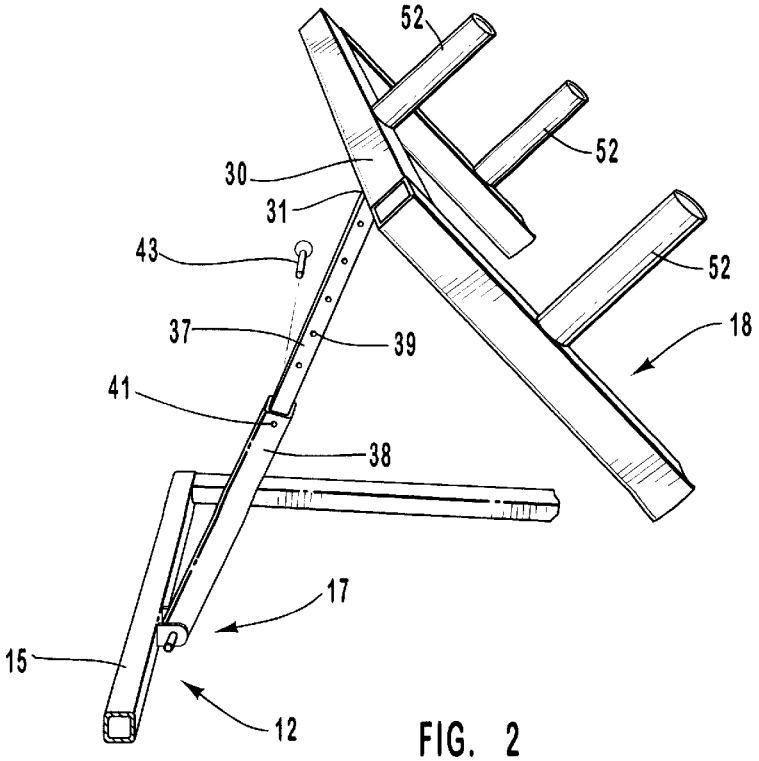
FIG. 2 is a partial perspective view of a portion of the first preferred embodiment of the apparatus of FIG. 1.

Looking now at FIG. 2, leg 34 is shown in more detail. Upper leg member 37 is pivotally attached to side 30 of frame 18 by hinge piece 31 (hidden). Lower leg member 38 is pivotally attached to a side member 15 of base 12 by a hinge piece 17 similar to hinge piece 31. Lower leg member 38 has a slightly larger diameter than upper leg number 37 to allow upper leg member 37 to be inserted telescopically therein. Upper leg member 37 has a plurality of spaced holes 39 therethrough which can be aligned with a hole 41 in the upper portion of lower leg 38. A pin 43 is inserted through holes 39 and 41 to secure upper leg 37 and lower leg 38 in various telescoping positions so as to vary the angle of frame 18 relative to base 12.

Figure 3:
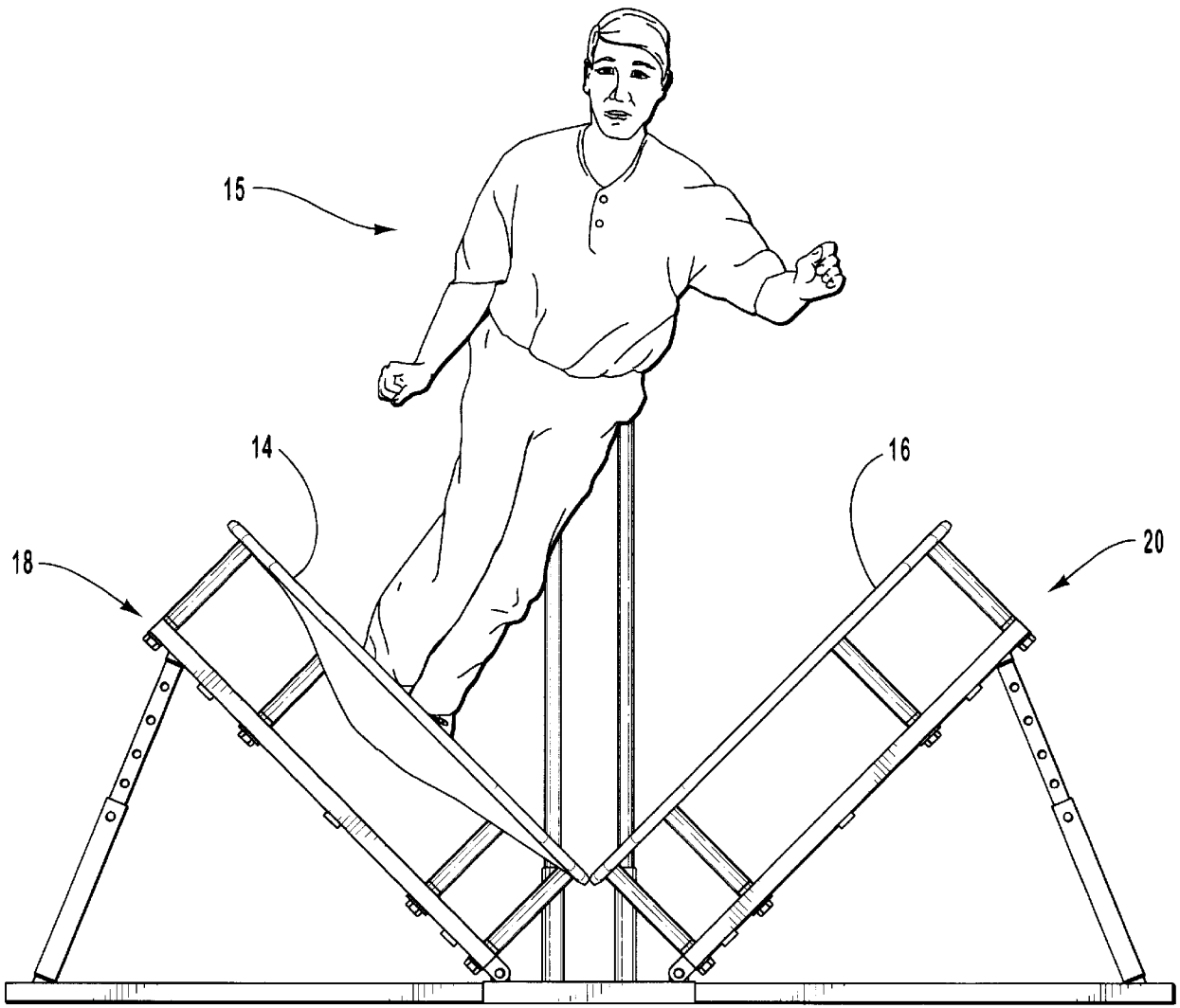
FIG. 3 is a front view of the first preferred embodiment of the apparatus of FIG. 1 showing the use of the apparatus in practicing mogul skiing.

Accordingly, as shown in FIG. 3, frame members 18 and 20 can be substantially inclined relative to each other to cause the surfaces of trampolines 14 and 16 to be pitched at angles substantially tilted with respect to the horizontal. In this manner an individual 15 jumping from one trampoline to the other, as shown in FIG. 3, can simulate extremely difficult mogul conditions.

Figure 4:
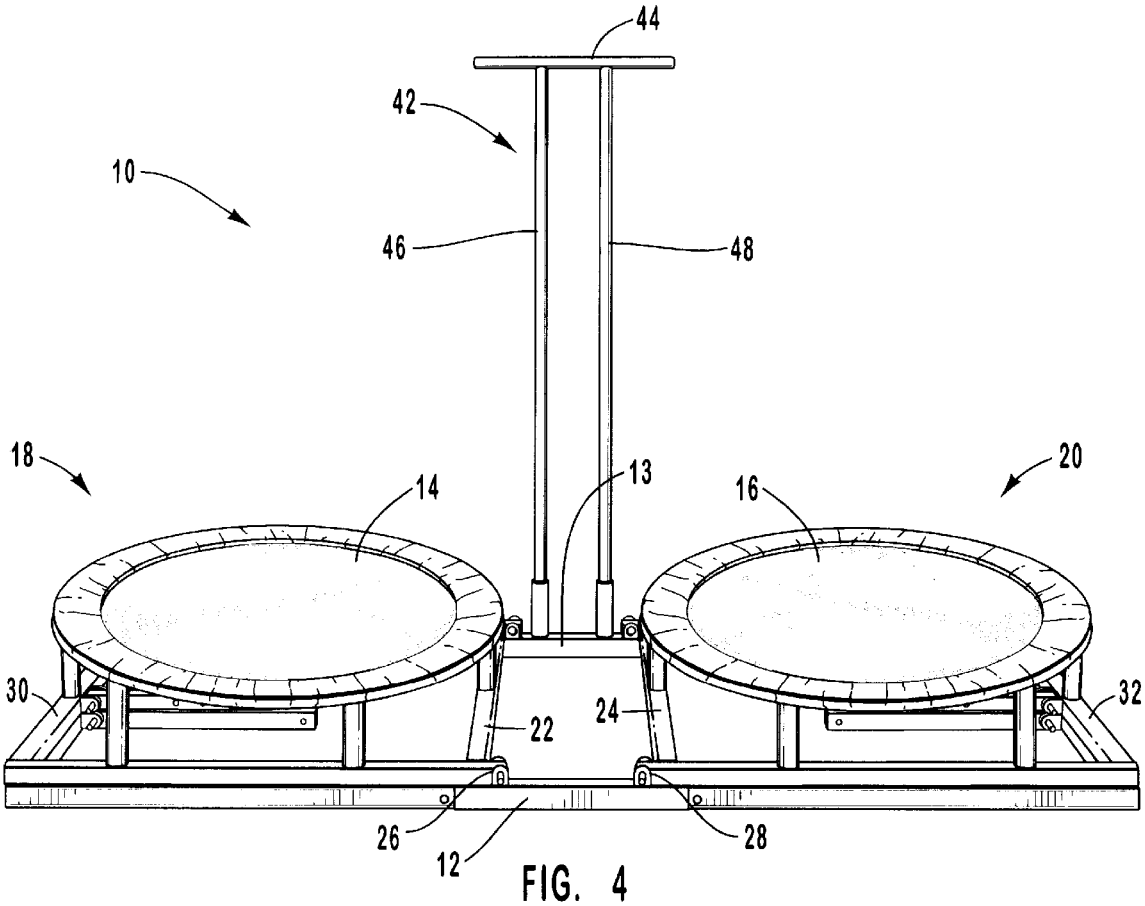
FIG. 4 is perspective view of the first preferred embodiment of the present invention showing the rebounders in a horizontal position.

In contrast, as shown in FIG. 4, telescoping legs 34 and 36 can be telescoped within each other so that frames 18 and 20 sit flush on base frame, 12 thereby disposing the surfaces of trampolines 14 and 16 in a substantially horizontal position. In this position, the trampolines do not simulate mogul conditions but rather flat downhill skiing conditions. Alternately, the horizontal trampolines may remain in place or be removed and used by two independent users simultaneously in order to provide for more conventional exercises.

Figure 5:
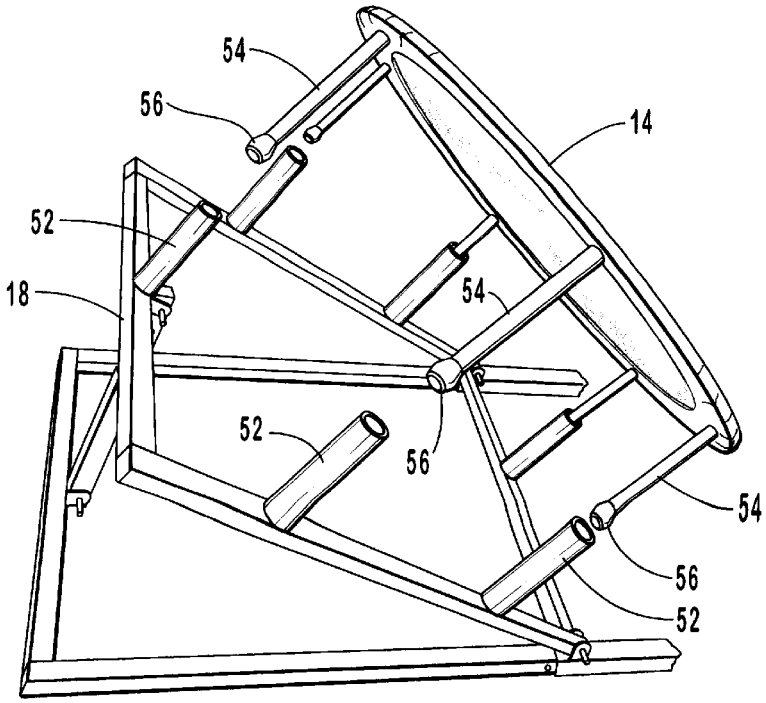
FIGS. 5 and 6 are close-up partial perspective views of the first preferred embodiment of the present invention showing the disassembly and assembly of the apparatus.

Referring now to FIG. 5, assembly and disassembly of the ski simulation apparatus 10 is shown. Frame member 18 includes a plurality of receptacles 52 disposed around frame 18 to correspond to the positions of legs 54 of a conventional rebounder or miniature trampoline 14. Each receptacle 52 is large enough in diameter to accept a leg 54, including the rubber based tip 56 which typically has a diameter larger than leg 54. Preferably, there are six receptacles spaced about frame member 18 so that each one can receive one of the six legs of a conventional rebounder 14. The receptacles 52 have a diameter about the same as the diameter of the tips 56 so that legs 54 may be removably secured in the receptacles by a force fit without any bolts or other attachment means. This arrangement enables easy removal of the trampolines 14 from receptacles 52 so that the trampolines may be used separately as conventional rebounders.

Figure 6:
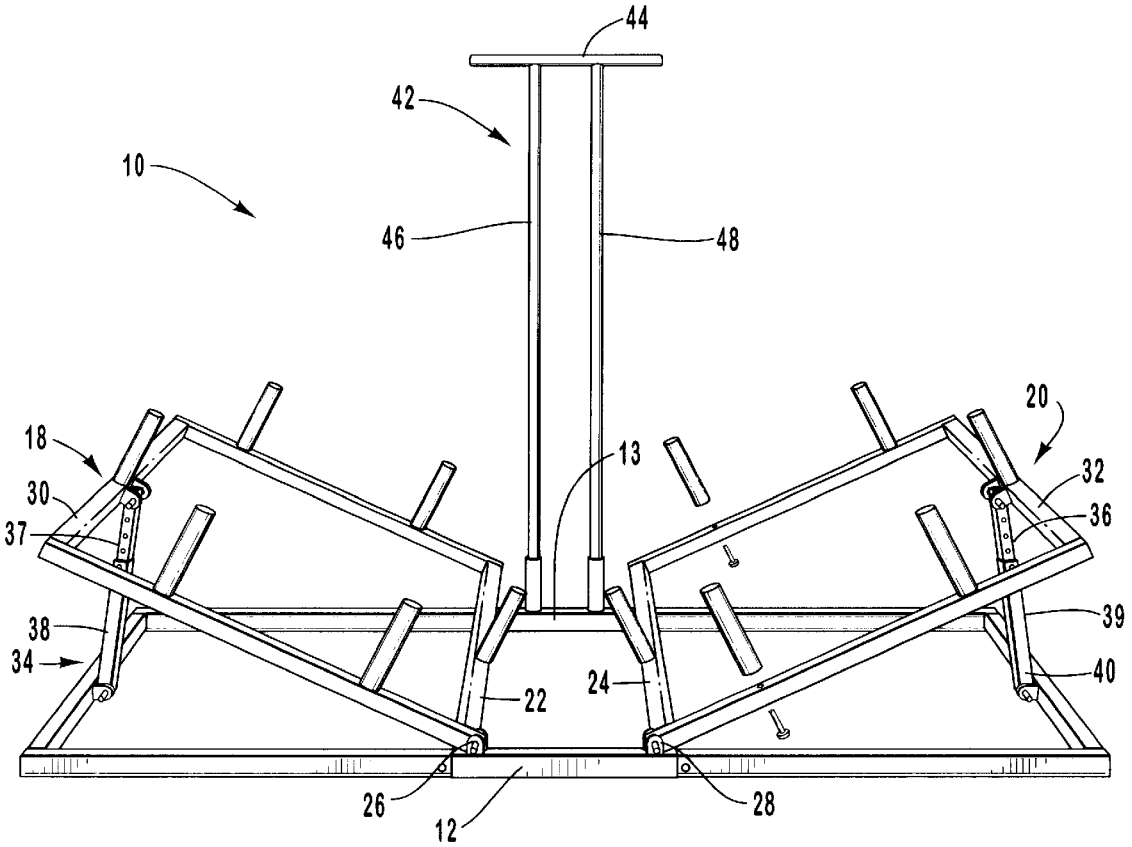
Figure 7:
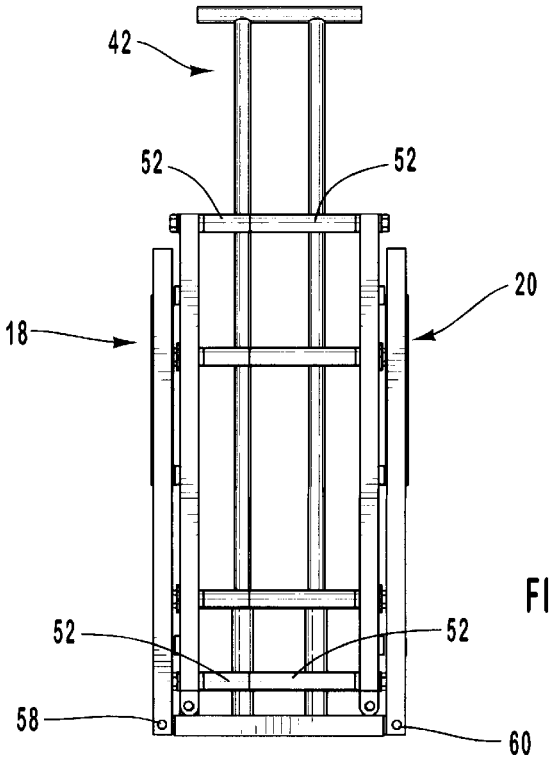
FIG. 7 is front view of the first preferred embodiment of the ski simulation apparatus of the present invention in which the framework has been folded for storage or transportation.

Looking now FIG. 6, rebounders 14 and 16 may be completely removed from frame members 18 and 20 which are then swivelled about the respective hinges 26 and 28 to an upright vertical position as shown in FIG. 7. Base 12 is also rotatable about separate hinge members 58 and 60 so as to fold up adjacent to frames 18 and 20 for transport. Receptacles 52 are offset from each other, either horizontally or vertically so that they bypass each other during the folding operation and allow the frames 18 and 20 to be rotated to a completely vertical position.

Figure 8:
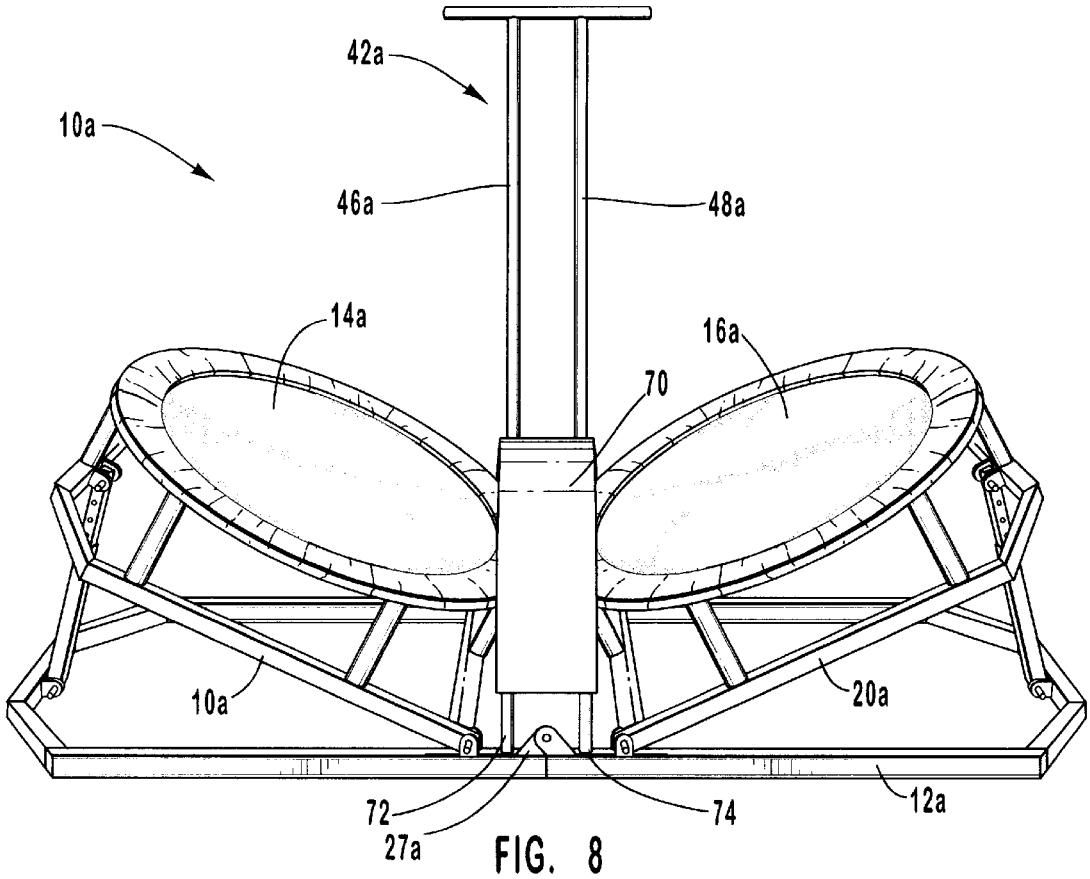
FIG. 8 is a perspective view of another preferred embodiment of the ski simulation apparatus of the present invention.
Figure 9:
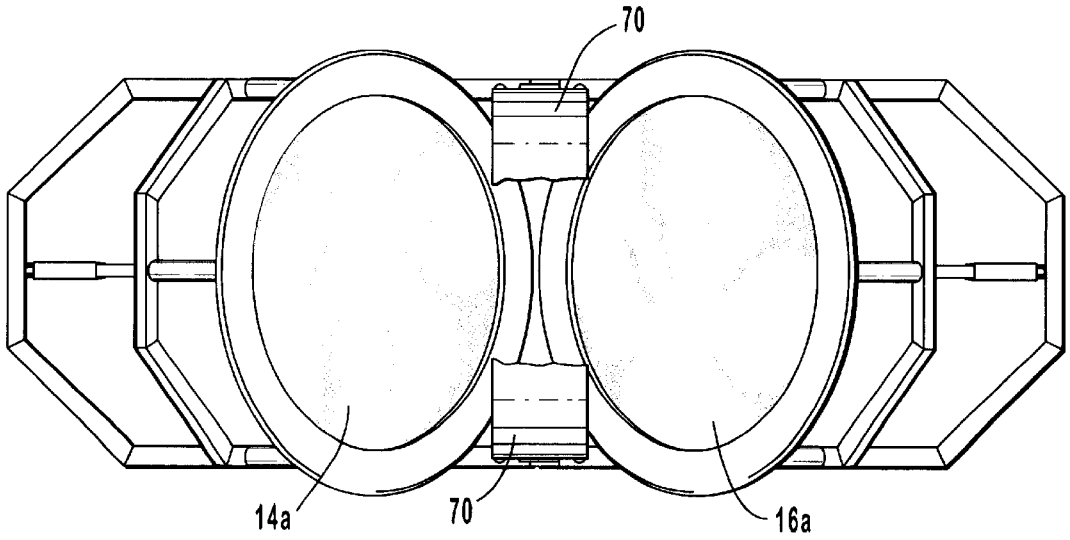
FIG. 9 is a plan view of the embodiment shown in FIG. 8.
Figure 10:
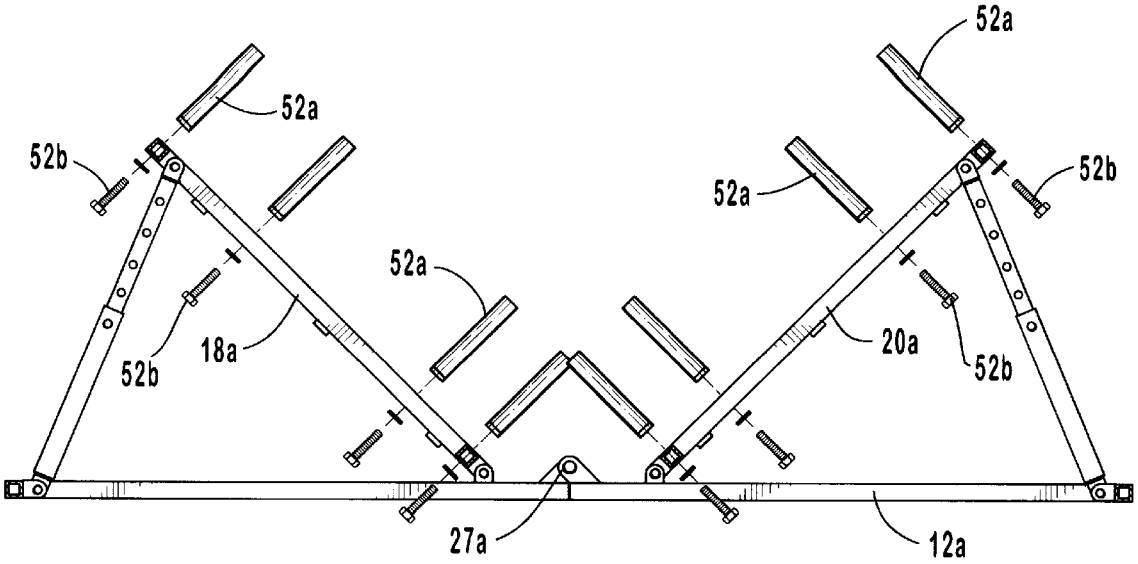
FIG. 10 is a front view of the embodiment shown in FIG. 8 in partial disassembly.
Figure 11:
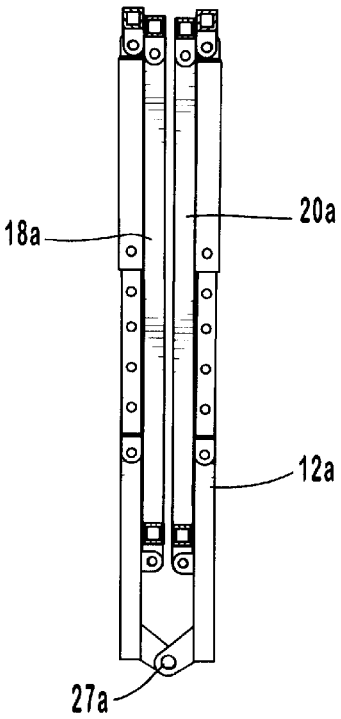
FIG. 11 is a front view of the embodiment shown in FIG. 8 fully disassembled for storage ir transportation.

An alternate embodiment is shown in FIGS. 8–11 wherein, in which receptacles 52*a* are removably bolted to frame members 18 and 20 by bolts 52*b* so that they can be removed during disassembly, as shown in FIG. 10. Frame 12*a* is hinged at the center by hinges 27*a* thereby allowing frames 18*a* and 20*a* to be folded substantially flush with each other and with the base portions of base 12 folded closely adjacent thereto. The resulting folded frame members have a combined width of only the width of frame members 18*a*, 20*a* and 12*a*, as shown in FIG. 11, thereby greatly facilitating storage in a narrow container to be transported to another location. Alternately, a rubber spacer may be place between the frame members for cushioning. By being able to remove the trampolines and the trampolines leg receptacles, the resulting folded frame is substantially lighter to move as well.

The embodiment shown in FIGS. 8 and 9 includes a platform 70 attached to the vertical posts 46*a* and 48*a* of handle member 42*a* at the back and attached to base frame 12*a* by supports 72 and 74 at the front end of frame 12*a*. Platform 70 is preferable attached in any conventional manner, such as by welding or conventional bolts for easy disassembly.

In the preferred embodiments trampolines 14 and 16 are conventional round rebounders or miniature trampolines which can be purchased on the open market. However, it is preferred that the trampolines are of a substantially heavier construction that the common inexpensive rebounders available through mass marketing. The rebounders for the present invention must be of sufficient strength and having a sufficiently strong elements that they will withstand the stresses of ski jump simulation while accurately simulating ski conditions. One source for such rebounders is the "REBOUND AIR" manufactured by A.I.R., Inc. located in Provo, Utah.

Preferably base frame 12 and frame members 18 and 20 are manufactured of square steel hollow tubing or standard steel pipe about one and one half inch square. Preferably, receptacles 50 and legs 34 and 36 are also made of hollow steel tubing of about the same size to perform the leg telescoping functions and the trampoline leg receptacle functions. While the preferred embodiment in several variations of the invention have been shown and suggested, it should be understood that suitable additional modifications, changes, substitutions and alterations may be made without departing from the spirit of the invention.

What is claimed is:

1. A multiple rebounder ski simulator apparatus comprising:

(a) a base framework disposed for support on a surface having means for supporting at least two rebounders;

(b) first and second frame members pivotally attached to the framework, each being disposed for supporting and securing a rebounder thereon;

(c) first and second rebounders, each being supported on and secured by the first and second frame members respectfully;

(d) first and second leg members attached between the framework and the first and second frame members, respectively, to support the frame members in multiple inclined positions relative to the framework, so as to position first and second trampolines at varying angles relative to each other.

2. The ski simulator apparatus claim 1 wherein the first and second frame members are hinged to the framework adjacent to each other, thereby being pivoted to a vertical position for storage and transportation.

3. The ski simulator apparatus of claim 1 wherein the first and second frame members each have multiple receptacles mounted thereon for each receiving one of the leg members of each of said rebounders therein.

4. The ski simulator apparatus of claim 3 wherein the receptacles are removable from the frame members.

5. The ski simulator apparatus of claim 1 wherein the first and second leg members each comprise an upper leg member pivotally attached to one side of the respective frame member and a lower leg member pivotally attached to the one side of the base of the framework, wherein the upper and lower leg members telescope within each other and have attachment means for securing the upper and lower leg members relative to each other at telescoping positions.

6. The ski simulator of claim 5 wherein the upper and lower leg members are removable from each other and pivotable for storage and transportation.

7. The ski simulation apparatus of claim 1 further comprising handle means attached to the base framework for a users hands to grasp while jumping between the first and second rebounders.

8. The ski simulator apparatus of claim 1 wherein the first and second trampolines are each removably secured to the first and second frame members.

9. The ski simulator apparatus of claim 1 wherein the base framework is pivotally attached together, so as to be folded for storage and transportation.

10. A multiple trampoline practice apparatus for simulating ski conditions, comprising a base framework having first and second frame members thereon for supporting at least two trampolines;

first and second trampolines supported on the first and second frame members respectively;

the first and second frame members being pivotally secured to the base framework and having tilting means connected thereto for fixably disposing each frame member at an angle relative to the base member and independent of the angle formed by the other frame member relative to the base member, and means on the first and second frame members for securing said first and second trampolines to the first and second frame members respectfully.

11. The ski simulator apparatus of claim 1 wherein the first and second frame members are pivotal to a vertical position for storage and transportation.

12. The apparatus of claim 10 wherein the base framework includes two base members, each connected to a hinge member and rotatable to a vertical position to facilitate and/or transportation.

13. The ski simulator apparatus of claim 10 wherein the first and second trampolines are removable from the first and second frame members to facilitate storage and or transportation.

14. The ski simulator apparatus of claim 10 wherein said first and second trampolines each have multiple legs and wherein the first and second frame members each have a plurality of removable receptacles for securing the legs of the first and second trampolines respectfully.

15. The ski simulator apparatus of claim 14 wherein the removable receptacles removably secure the legs of the first and second trampoline so that the trampolines may be lifted directly out of the receptacles.

16. The ski simulator apparatus of claim 10 and further including a platform extending between the trampolines substantially horizontal.

17. The ski simulator apparatus of claim 16 wherein the platform is secured to the base framework.

18. A method of simulating downhill skiing and snowboarding utilizing framework which supports at least two rebounders located adjacent to each other and capable of being tilted at various degrees to the horizontal comprising (a) securing each rebounder separately to a common framework so that each rebounder is spaced a predetermined distance from the other rebounders:

(b) tilting each rebounder at a desired angle relative to the horizontal;

(c) jumping or springing from one rebounder to the other at different speeds and intensities to simulate skiing conditions;

(d) alternating the angles of one rebounder relative to the other to simulate multiple variations in skiing conditions.

19. The method of simulating skiing wherein each rebounder is independently angled relative to the horizontal to simulate variations in skiing conditions.

* * * * *